US009463903B2

(12) United States Patent
Garrett, Sr. et al.

(10) Patent No.: US 9,463,903 B2
(45) Date of Patent: Oct. 11, 2016

(54) DOOR MOUNTABLE STORAGE SYSTEM

(71) Applicants: William E. Garrett, Sr., Madison, IL (US); Sarah R. Garrett, Madison, IL (US)

(72) Inventors: William E. Garrett, Sr., Madison, IL (US); Sarah R. Garrett, Madison, IL (US)

( * ) Notice: Subject to any disclaimer, the term of this patent is extended or adjusted under 35 U.S.C. 154(b) by 189 days.

(21) Appl. No.: 14/292,051

(22) Filed: May 30, 2014

(65) Prior Publication Data

US 2015/0344184 A1 Dec. 3, 2015

(51) Int. Cl.

| | |
|---|---|
| ***A47G 29/087*** | (2006.01) |
| ***B65D 25/22*** | (2006.01) |
| ***B65D 43/16*** | (2006.01) |
| ***A47G 25/06*** | (2006.01) |
| ***B65D 55/14*** | (2006.01) |
| ***B65D 47/32*** | (2006.01) |
| ***B65D 6/02*** | (2006.01) |
| ***B65D 6/00*** | (2006.01) |

(52) U.S. Cl.

CPC ..... *B65D 25/22* (2013.01); *A47G 25/0621* (2013.01); *B65D 7/06* (2013.01); *B65D 11/10* (2013.01); *B65D 43/16* (2013.01); *B65D 47/32* (2013.01); *B65D 55/14* (2013.01)

(58) Field of Classification Search

CPC ..... A47G 25/0621; A47G 25/08; A47G 25/0614; A47G 25/06; A47G 25/0685; A47G 7/045; A47F 5/00; D06F 57/12; A47B 61/02; B65D 25/22; B65D 43/16; B65D 47/32; B65D 55/14; B65D 7/06; B65D 11/10; F16M 13/02

USPC ..... 211/119.004, 96, 113, 86.01, 87.01; 16/355, 356; 248/213.1

See application file for complete search history.

(56) References Cited

U.S. PATENT DOCUMENTS

| | | | | | |
|---|---|---|---|---|---|
| 284,090 | A | * | 8/1883 | Tingle | 211/75 |
| 496,173 | A | * | 4/1893 | Smith | 211/75 |
| 914,697 | A | * | 3/1909 | Bryant | 248/290.1 |
| 1,208,986 | A | * | 12/1916 | Krodel | 248/282.1 |
| 1,980,730 | A | * | 11/1934 | Matchette | 312/200 |
| 2,054,371 | A | * | 9/1936 | Bilt | 211/119.004 |
| 2,269,940 | A | * | 1/1942 | Johnson | 312/205 |
| 2,270,802 | A | * | 1/1942 | Kristensen | 248/301 |
| 2,561,806 | A | * | 7/1951 | Mailland | 211/96 |
| 2,595,521 | A | * | 5/1952 | Hanson | 211/119.004 |
| 2,633,997 | A | * | 4/1953 | Johnson | 211/96 |
| 2,684,225 | A | * | 7/1954 | Johnson | 248/213.1 |
| 2,895,698 | A | * | 7/1959 | Palmer | 248/213.1 |
| 2,896,791 | A | * | 7/1959 | Raber | 211/119.004 |
| 3,043,523 | A | * | 7/1962 | Hogstrom | 239/274 |
| 3,044,630 | A | * | 7/1962 | Szabo | 211/119.004 |

(Continued)

FOREIGN PATENT DOCUMENTS

DE 202006007448 7/2006

*Primary Examiner* — Jennifer E Novosad

(57) ABSTRACT

A door mountable storage system hingedly attaches to a door to provide storage space behind the door. The assembly includes a container having a bottom wall and a perimeter wall coupled to and extending upwardly from the bottom wall. The perimeter wall includes a front wall, a rear wall, a first lateral wall and a second lateral wall. The front and rear walls are coupled to and extend between the first and second lateral walls. A door is provided. The door has a door hinge attached to a first side edge of the door. A plurality of knuckles is coupled to the container and each is vertically aligned with respect to each other. Each of the knuckles is couplable to the door hinge for supporting the container on the door hinge.

11 Claims, 6 Drawing Sheets

(56) References Cited

U.S. PATENT DOCUMENTS

| | | | | | |
|---|---|---|---|---|---|
| 3,175,696 | A | * | 3/1965 | Milbourne | 211/119.004 |
| 3,825,127 | A | * | 7/1974 | Morrison et al. | 211/96 |
| 4,494,690 | A | * | 1/1985 | Dupuis | 232/22 |
| 4,703,850 | A | * | 11/1987 | Walker | 206/293 |
| 4,721,212 | A | * | 1/1988 | Lowe | 211/119.004 |
| 5,027,948 | A | * | 7/1991 | Forbes et al. | 206/387.11 |
| 5,405,043 | A | * | 4/1995 | Meloney | 220/578 |
| 5,433,375 | A | * | 7/1995 | Warrick | 232/1 C |
| 5,505,317 | A | * | 4/1996 | Rulis et al. | 211/119.004 |
| D371,033 | S | | 6/1996 | Lowe | |
| 5,590,608 | A | * | 1/1997 | Yore et al. | 109/50 |
| 5,738,020 | A | * | 4/1998 | Correia | 109/51 |
| 5,845,843 | A | * | 12/1998 | Kuller | 232/38 |
| 6,050,427 | A | * | 4/2000 | Loveland | 211/119.004 |
| 6,193,084 | B1 | * | 2/2001 | Oliver | 211/119.004 |
| 6,196,398 | B1 | * | 3/2001 | Lowe | 211/96 |
| 6,206,210 | B1 | * | 3/2001 | Reed | 211/96 |
| 6,658,696 | B2 | * | 12/2003 | Buckelew | 16/82 |
| 6,712,228 | B2 | * | 3/2004 | Lowe | 211/119.004 |
| 6,722,511 | B1 | * | 4/2004 | Lowe | 211/119.004 |
| D574,124 | S | * | 7/2008 | Huber | D99/28 |
| 7,780,017 | B2 | * | 8/2010 | Nguy et al. | 211/70.6 |
| 7,845,502 | B1 | * | 12/2010 | Grosz et al. | 211/187 |
| 7,908,711 | B2 | * | 3/2011 | Johnson | 16/366 |
| 8,113,608 | B2 | | 2/2012 | Tassin et al. | |
| 8,439,210 | B1 | * | 5/2013 | Griffith | 211/119.004 |
| 8,777,339 | B2 | * | 7/2014 | Tassin et al. | 312/249.2 |
| 2015/0230867 | A1 | * | 8/2015 | DeVore | 211/119.004 |
| 2015/0314933 | A1 | * | 11/2015 | Garthe | 211/119.004 |
| 2015/0344184 | A1 | * | 12/2015 | Garrett et al. | 211/119.004 |

* cited by examiner

DOOR MOUNTABLE STORAGE SYSTEM

BACKGROUND OF THE DISCLOSURE

Field of the Disclosure

The disclosure relates to storage systems and more particularly pertains to a new storage system for hingedly attaching to a door to provide storage space behind the door.

SUMMARY OF THE DISCLOSURE

An embodiment of the disclosure meets the needs presented above by generally comprising a container having a bottom wall and a perimeter wall coupled to and extending upwardly from the bottom wall. The perimeter wall includes a front wall, a rear wall, a first lateral wall and a second lateral wall. The front and rear walls are coupled to and extend between the first and second lateral walls. A door is provided. The door has a door hinge attached to a first side edge of the door. A plurality of knuckles is coupled to the container and each is vertically aligned with respect to each other. Each of the knuckles is couplable to the door hinge for supporting the container on the door hinge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
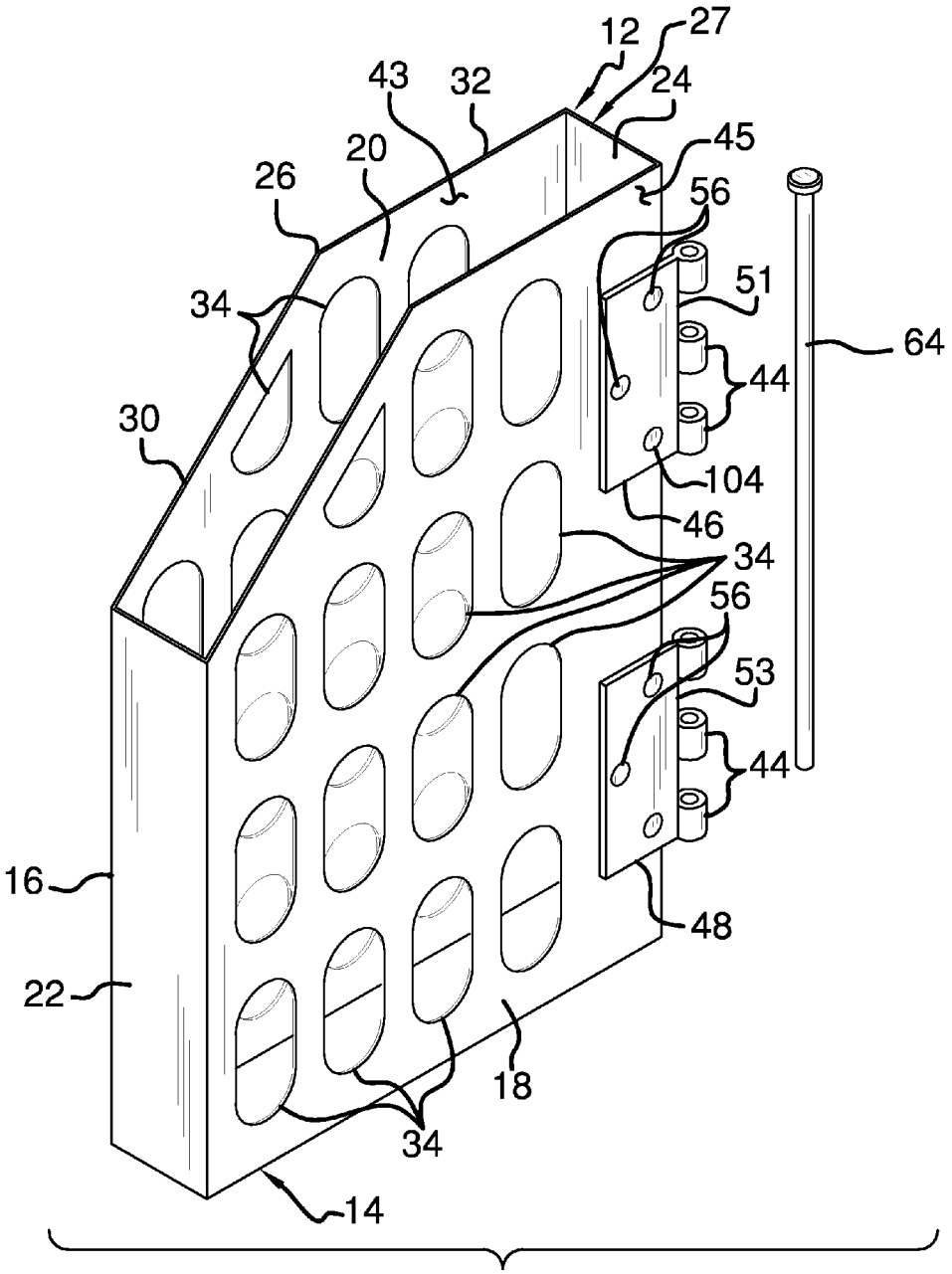
FIG. 1 is a top front side perspective view of a door mountable storage system according to an embodiment of the disclosure.
Figure 2:
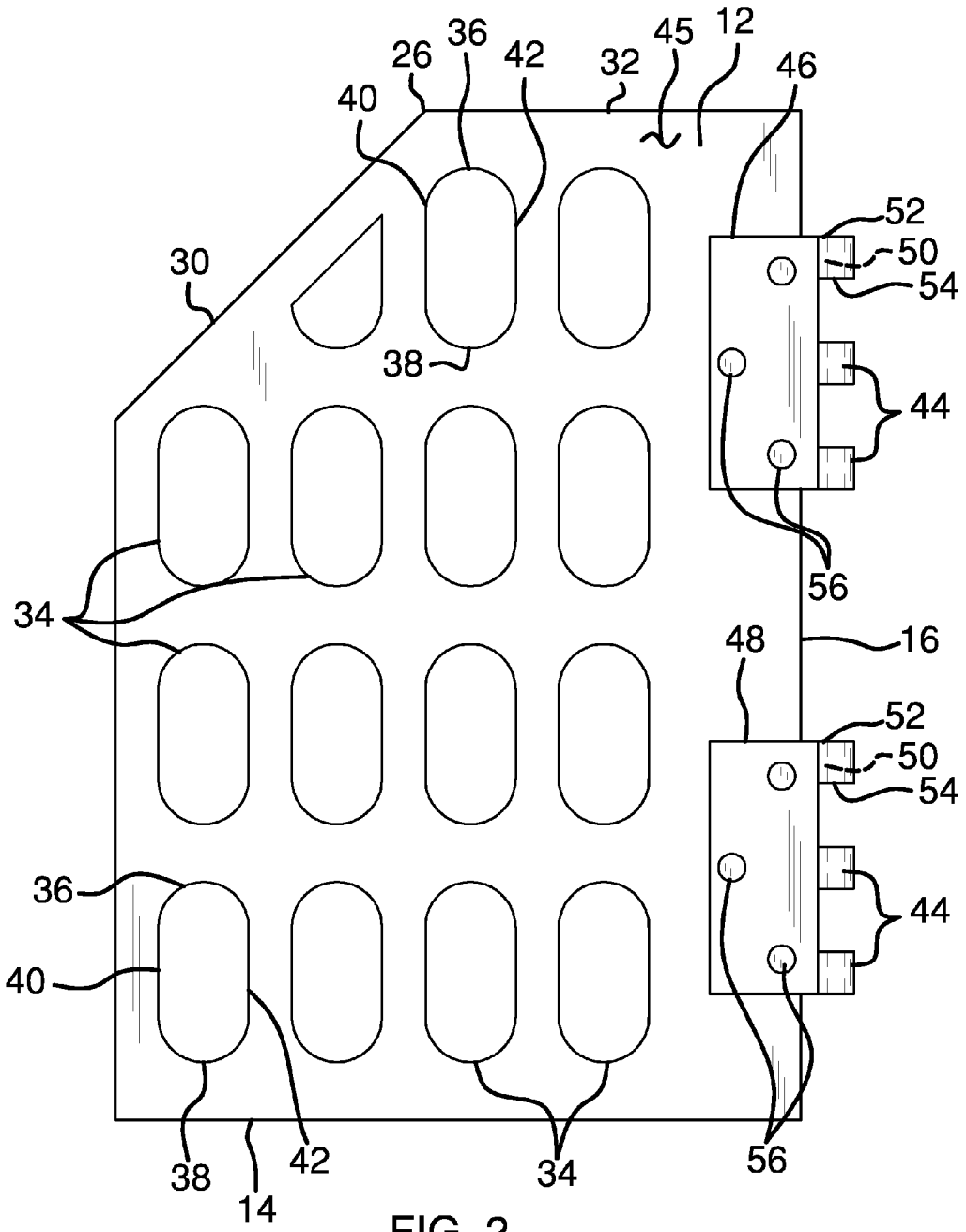
FIG. 2 is a front view of an embodiment of the disclosure.
Figure 3:
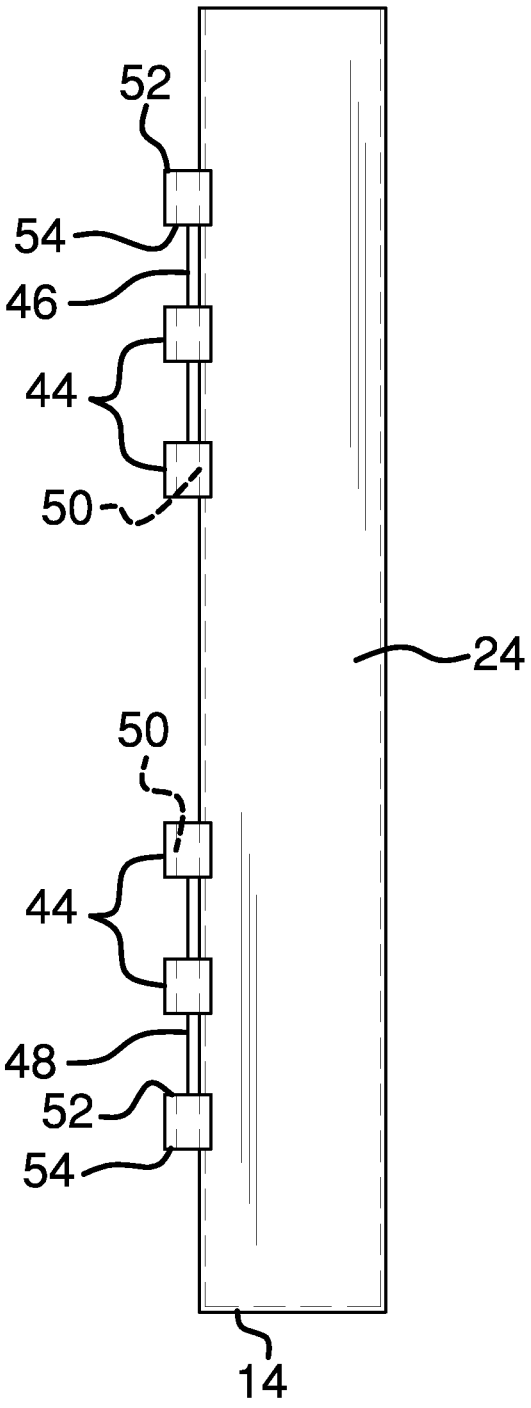
FIG. 3 is a side view of an embodiment of the disclosure.
Figure 4:
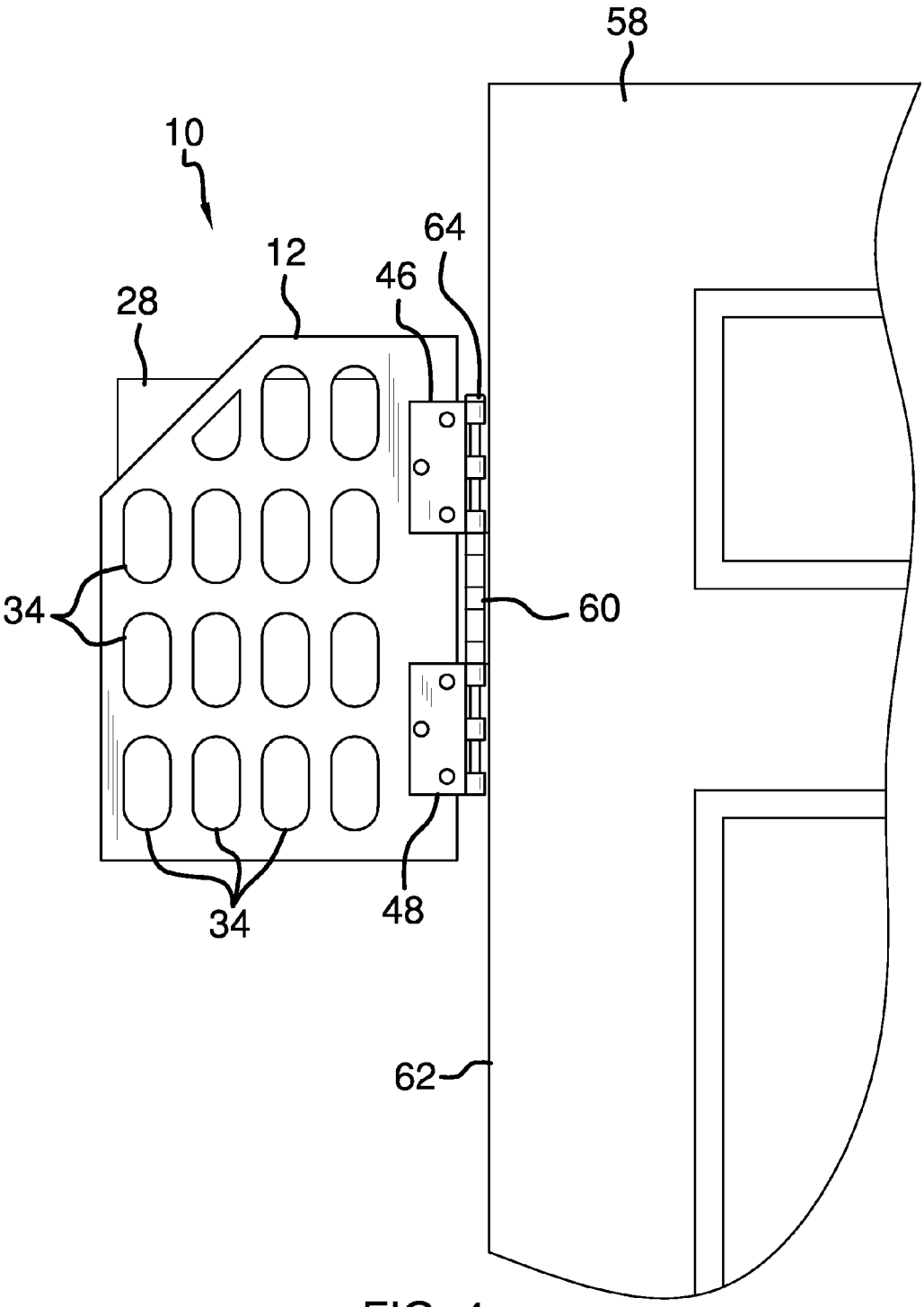
FIG. 4 is an in-use front view of an embodiment of the disclosure.

With reference now to the drawings, and in particular to FIGS. 1 through 6 thereof, a new storage system embodying the principles and concepts of an embodiment of the disclosure and generally designated by the reference numeral 10 will be described.

As best illustrated in FIGS. 1 through 6, the door mountable storage system 10 generally comprises a container 12 having a bottom wall 14 and a perimeter wall 16 coupled to and extending upwardly from the bottom wall 14. The perimeter wall 16 includes a front wall 18, a rear wall 20, a first lateral wall 22 and a second lateral wall 24. The front 18 and rear 20 walls are coupled to and extend between the first 22 and second 24 lateral walls. The container 12 has a top perimeter edge 26 defining an access opening 27 into an interior of the container 12. The interior of the container 12 is configured to store items 28, such as magazines, mail, or the like, therein. The top perimeter edge 26 includes a straight section 32 extending from the second lateral wall 24 toward the first lateral wall 22. The top perimeter edge 26 may also include a slanted section 30 coupled to the straight section 32 extending from the first lateral wall 22 toward the second lateral wall 24. A plurality of hooks 25 may be attached to the bottom wall 14 of the container 12 to allow hanging of objects therefrom.

A lid 29 may be pivotally coupled to the top perimeter edge 26 to close the access opening 27. The lid 29 may include a planar section 35 and a projecting section 37 coupled to and extending downwardly from a front end 39 of the planar section 35. A locking mechanism 31 releasably secures the lid 29 to the top perimeter edge 26. The locking mechanism 31 is generally conventional and may include a slot 33 configured to receive a key therein for locking and unlocking the locking mechanism 31.

Figure 5:
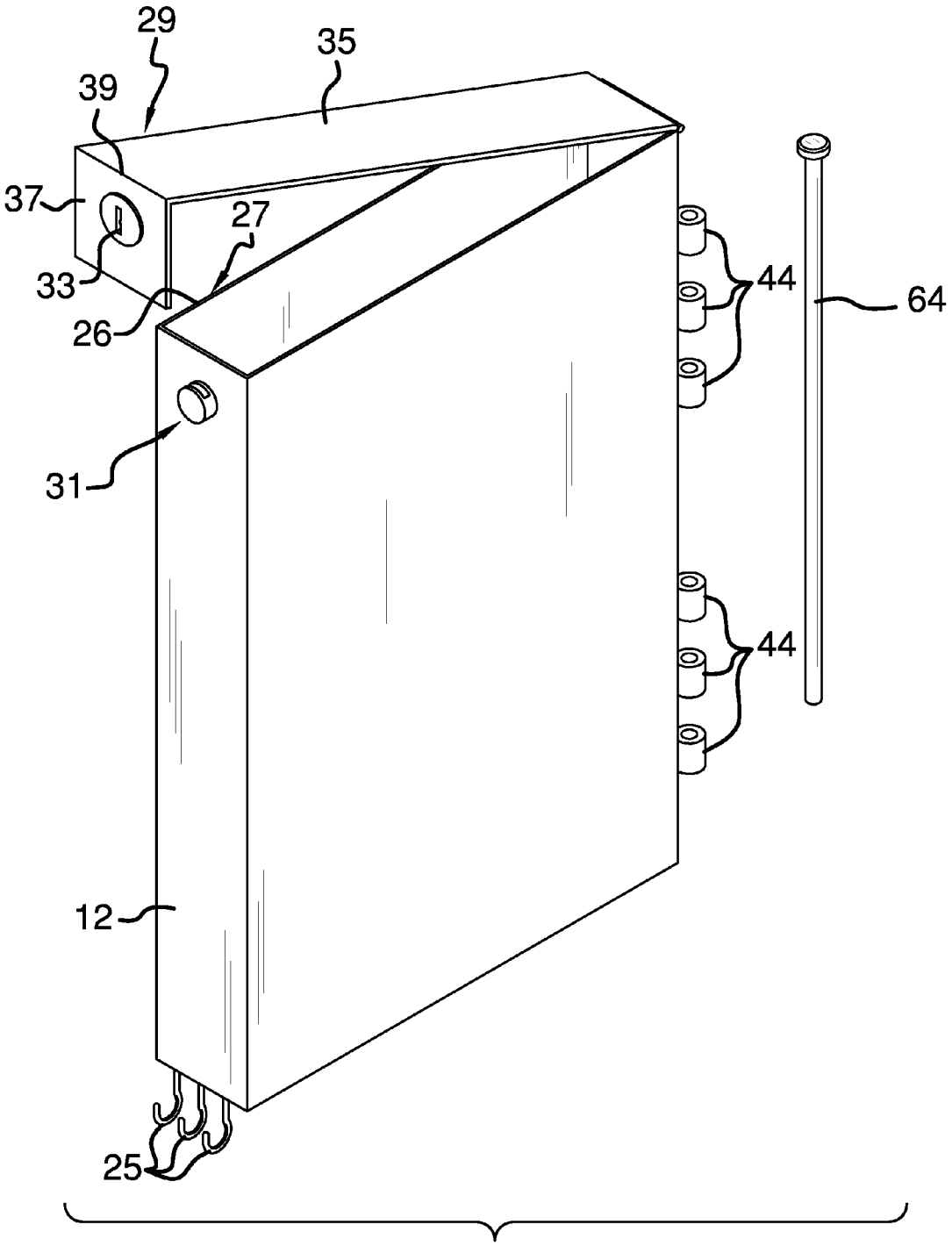
FIG. 5 is a top front side perspective view of an alternative embodiment of the disclosure.
Figure 6:
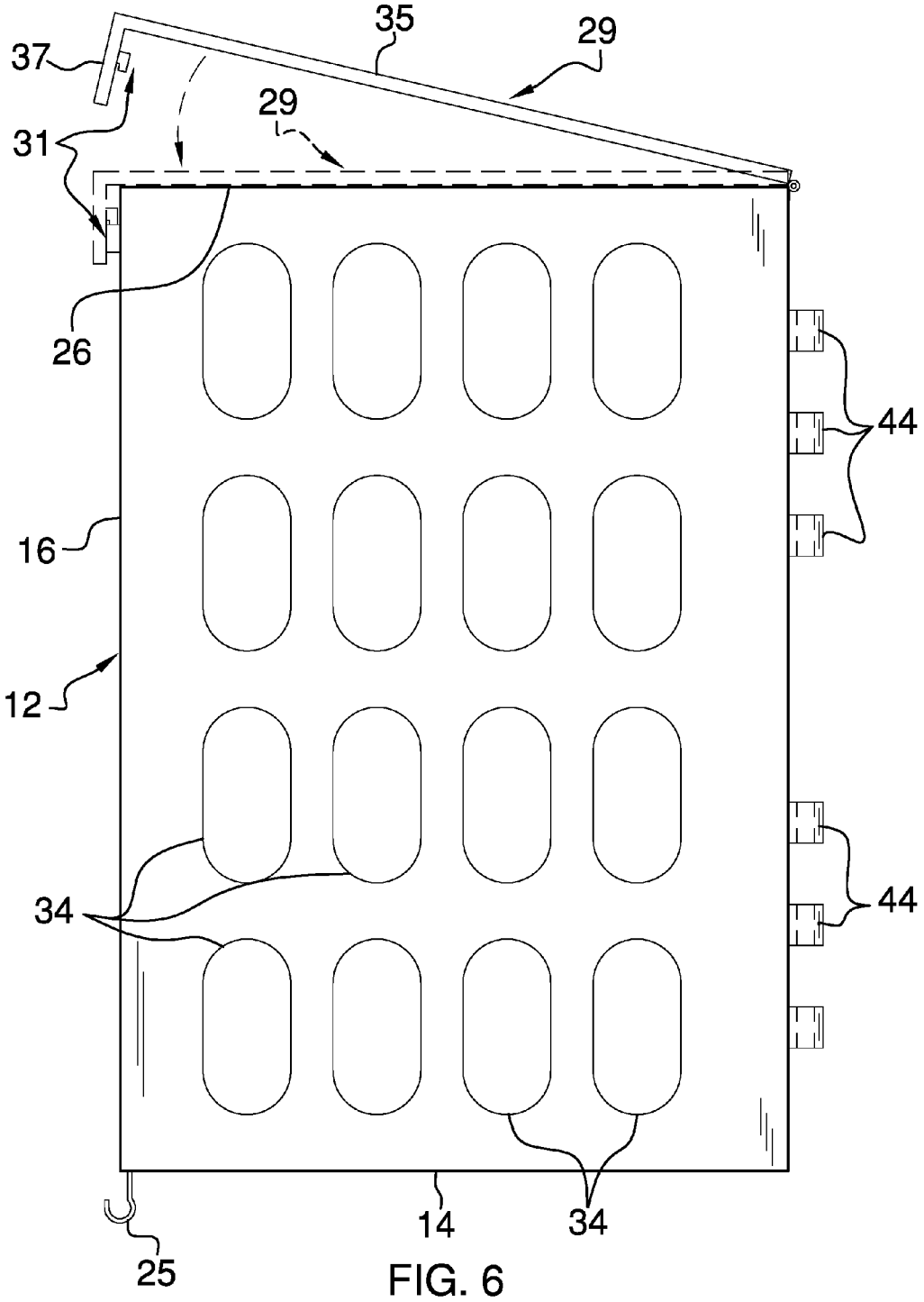
FIG. 6 is a front view of an alternative embodiment of the disclosure.

The container 12 may have a plurality of openings 34 positioned in the perimeter wall 16 wherein the openings 34 are configured to provide ventilation to items 28 stored in the container 12. This is particularly useful when items 28 that may be damp, such as clothing or the like, are placed within the container 12. Each of the openings 34 may be elongated and may have an oval shape. In particular, the openings 34 may have a length between approximately 4.0 cm and 8.0 cm as measured from a top 36 to a bottom 38 of each opening 34. The openings 34 may have a width between approximately 2.0 cm and 4.0 as measured between opposite sides 40, 42 of each opening 34. Alternatively, as shown in FIGS. 5 and 6, the perimeter wall 16 may be solid between an inner surface 43 and an outer surface 45 of the perimeter wall 16. The second lateral wall 24 may have a height between approximately 28.0 cm and 42.0 cm as measured from the bottom wall 14 to the top perimeter edge 26. A distance between the first lateral wall 22 and the second lateral wall 24 may be between approximately 18.0 cm and 30.0 cm. The container 12 may be constructed from plastic, metal or other rigid material.

A plurality of knuckles 44 is coupled to the container 12 and each is vertically aligned with respect to each other. Each of the knuckles 44 may be integrally coupled to the container 12 through injection molding or other methods conventionally known in the art. Alternatively, the knuckles 44 may be attached to an associated plate 46, 48 that is coupled to the container 12 wherein the knuckles 44 are coupled to and extend outwardly from an associated side 51, 53 of the associated plate 46, 48. The knuckles 44 are attached to a single one of the front wall 18 and the rear wall 20 and may be positioned adjacent to the second lateral wall 24 such that each of the knuckles 44 extends outwardly beyond the second lateral wall 24. Whether the knuckles 44 are attached to the front wall 18 or the rear wall 20 determines whether the knuckles 44 are attachable to a door 58 that is right-handed or left-handed. Each of the knuckles 44 has a channel 50 extending therein between a respective top end 52 and bottom end 54 of the associated knuckle 44. Each of the channels 50 is vertically aligned with respect to each other. A plurality of fasteners 56 may be provided and each is attached to an associated one of the plates 46, 48 for securing the knuckles 44 to the container 12.

The door 58 may be of a generally conventional design. The door 58 has a door hinge 60 attached to a first side edge 62 of the door 58 for supporting the door 58 within a door frame. Each of the knuckles 44 is couplable to the door hinge 60 for supporting the container 12 on the door hinge 60. A hinge pin 64 is insertable into the door hinge 60 and into each of the channels 50 to couple the container 12 to the door hinge 60. Due to the size of the container 12, the hinge pin 64 has a greater length than the hinge pin conventionally used on a door hinge 60.

Unless otherwise described or mutually exclusive, the embodiment shown in FIGS. 1-4 is identical to the embodiment shown in FIGS. 5-6. Features from the version shown in FIGS. 5 and 6 can be selectively incorporated into the embodiment shown in FIGS. 1-4 to provide a number of different permutations for system 10. For example, the system 10 may include both the lid 29 and openings 34 or may include openings 34 and hooks 25, although these exact permutations are not shown in the Figures.

In use, as stated above and shown in the Figures, a conventional hinge pin that is typically used with a door hinge 60 on a door 58 is removed from the door 58. The container 12 is attached to the door hinge 60 using lengthened hinge pin 64. Objects can be hung from hooks 25, while items can be stored within the container 12. In this manner, the system 10 provides for a container 12 mounted to the door 58 that utilizes the dead space typically found behind such doors 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A door mountable storage system comprising:

a container having a bottom wall and a perimeter wall coupled to and extending upwardly from said bottom wall, said perimeter wall including a front wall, a rear wall, a first lateral wall and a second lateral wall, said front and rear walls being coupled to and extending between said first and second lateral walls, said container having a top perimeter edge defining an access opening into an interior of said container wherein said container is configured for storing items therein;

a door, said door having a door hinge attached to a first side edge of said door;

a plurality of knuckles coupled to said container each being vertically aligned with respect to each other, each of said knuckles being couplable to said door hinge for supporting said container on said door hinge, each of said knuckles having a channel extending therein between a respective top end and bottom end of said associated knuckle, each of said channels being vertically aligned with respect to each other;

a lid pivotally coupled to said top perimeter edge to close said access opening;

a hinge pin being insertable into said door hinge and into each of said channels for coupling said container to said door hinge; and a plurality of hooks attached to said bottom wall of said container wherein said hooks are configured to allow hanging of objects therefrom.

2. The system of claim 1, further comprising a locking mechanism releasably securing said lid to said top perimeter edge.

3. The system of claim 2, wherein said locking mechanism includes a slot configured to receive a key therein for locking and unlocking said locking mechanism.

4. The system of claim 1, further comprising a plurality of openings positioned in said perimeter wall wherein said openings are configured to provide ventilation to items positioned in said container.

5. The system of claim 1, further comprising each of said knuckles being integrally coupled to said container.

6. The system of claim 1, further comprising:

a plurality of plates, each of said plates being attached to said container; and each of said knuckles being attached to an associated one of said plates attached to said container, each of said knuckles extending outwardly from said associated one of said plates.

7. The system of claim 6, further comprising a plurality of fasteners each attached to an associated one of said plates for securing said knuckles to said container.

8. The system of claim 1, further comprising said lid including a planar section and a projecting section coupled to and extending downwardly from a front end of said planar section.

9. A door mountable storage system comprising:

a container having a bottom wall and a perimeter wall coupled to and extending upwardly from said bottom wall, said perimeter wall including a front wall, a rear wall, a first lateral wall and a second lateral wall, said front and rear walls being coupled to and extending between said first and second lateral walls, said container having a top perimeter edge defining an access opening into an interior of said container for storing items therein;

a plurality of openings positioned in said perimeter wall wherein said openings are configured to provide ventilation to items positioned in said container;

a plurality of hooks attached to said bottom wall of said container wherein said hooks are configured to allow hanging of objects therefrom;

a lid pivotally coupled to said top perimeter edge to close said access opening, said lid including a planar section and a projecting section coupled to and extending downwardly from a front end of said planar section;

a locking mechanism releasably securing said lid to said top perimeter edge, said locking mechanism including a slot configured to receive a key therein for locking and unlocking said locking mechanism;

a door, said door having a door hinge attached to a first side edge of said door;

a plurality of knuckles coupled to said container each being vertically aligned with respect to each other, each of said knuckles being couplable to said door hinge for supporting said container on said door hinge, each of said knuckles having a channel extending therein between a respective top end and bottom end of said associated knuckle, each of said channels being vertically aligned with respect to each other; and a hinge pin being insertable into said door hinge and into each of said channels for coupling said container to said door hinge.

10. The system of claim 9, further comprising each of said knuckles being integrally coupled to said container.

11. The system of claim 9, further comprising:

each of said knuckles being attached to an associated plate attached to said container, each of said knuckles extending outwardly from said associated plate; and a plurality of fasteners each attached to an associated one of said plates for securing said knuckles to said container.

* * * * *